US006277801B1

(12) United States Patent
Dahanayake et al.

(10) Patent No.: US 6,277,801 B1
(45) Date of Patent: Aug. 21, 2001

(54) LOW FOAMING SURFACTANT COMPOSITIONS USEFUL IN HIGHLY ALKALINE CAUSTIC CLEANERS

(75) Inventors: Manilal S. Dahanayake, Princeton Junction; Mark E. Ventura, Freehold, both of NJ (US)

(73) Assignee: Rhodia Inc., Cranbury, NJ (US)

( * ) Notice: Subject to any disclaimer, the term of this patent is extended or adjusted under 35 U.S.C. 154(b) by 0 days.

(21) Appl. No.: 09/411,108

(22) Filed: Oct. 4, 1999

Related U.S. Application Data

(63) Continuation-in-part of application No. 09/016,008, filed on Jan. 30, 1998, now abandoned.

(51) Int. Cl.[7] ..... C11D 3/22

(52) U.S. Cl. ..... 510/218; 510/219; 510/225; 510/233; 510/490

(58) Field of Search ..... 510/218, 219, 510/225, 233, 490

(56) References Cited

U.S. PATENT DOCUMENTS

| | | | |
|---|---|---|---|
| 4,528,039 | 7/1985 | Rubin et al. | 134/2 |
| 4,695,396 | 9/1987 | Rossmann et al. | 252/135 |
| 4,731,194 | 3/1988 | Rossmann et al. | 252/160 |
| 4,891,149 | 1/1990 | Nadolsky | 252/545 |
| 5,045,232 | 9/1991 | Dahanayake | 252/321 |
| 5,192,461 | 3/1993 | Tomaszewski et al. | 252/156 |
| 5,200,114 | 4/1993 | Beck | 252/542 |
| 5,250,230 | 10/1993 | Steele et al. | 252/544 |
| 5,364,551 | 11/1994 | Lentsch et al. | 252/156 |
| 5,380,468 | 1/1995 | Gober et al. | 252/547 |
| 5,486,315 | 1/1996 | Tseng . | |
| 5,597,793 | 1/1997 | Beese et al. | 510/434 |
| 5,670,467 | 9/1997 | Fleisher | 510/224 |

FOREIGN PATENT DOCUMENTS

| | | |
|---|---|---|
| 0263911 | 4/1988 | (EP) . |
| 9629384 | 9/1996 | (WO) . |
| 9738079 | 10/1997 | (WO) . |

*Primary Examiner*—Necholus Ogden
(74) *Attorney, Agent, or Firm*—Stevens, Davis, Miller & Mosher, LLP

(57) ABSTRACT

Highly alkaline caustic cleaners used in large scale industrial applications are stabilized and enhanced with improved surface tension reduction and decreased foaming properties through the incorporation of minor amounts of a surfactant composition comprising a alkylether hydroxypropyl sultaine surfactant and a nonionic ethoxylated surfactant.

8 Claims, No Drawings

LOW FOAMING SURFACTANT COMPOSITIONS USEFUL IN HIGHLY ALKALINE CAUSTIC CLEANERS

This application is a continuation-in-part of U.S. Ser. No. 09/016,008 filed Jan. 30, 1998 now abandoned.

FIELD OF THE INVENTION

The present invention relates generally to industrial cleaners and their use in cleaning industrial surfaces and parts. More specifically, the invention relates to low foaming detergent compositions useful in highly caustic cleaners.

BACKGROUND OF THE INVENTION

The production of beer and wine in the United States has resulted in the development of huge industries that are enjoying enormous growth. These and other alcohol-containing beverages generally require fermentation in large vats or tanks in which the ingredients, i.e. hops, barley, malt, etc., are cooked and then fermented with a bacterial culture that metabolizes the sugars and carbohydrates to produce the alcohol. However, over time, some of these components solidify and form residues or deposits and accumulate on the walls, floors and ceilings of the tanks and periodic cleaning is required.

For many years, major brewers have employed highly caustic cleaners for cleaning their production facilities. One of the more tenacious cleaning problems encountered is the development of proteinaceous "beer stone" deposits on the inner surfaces of the tanks. The difficulty in removing these residues is one of the reasons highly caustic cleaners are required. For purposes of this disclosure, "highly alkaline" refers to cleaners containing levels of about 10% to 50% alkali. Whereas this 10–50% level is actually the amount of alkali or builders incorporated in these cleaners in their concentrated form, for cleaning purposes the cleaner is diluted to an actual average use concentration of about 2.75% when mixed with water and the other ingredients.

These highly alkaline cleaners also comprise other detergents and surfactants that are necessary in order to fully clean the surfaces of these tanks. One problem that must be solved is that the proteinaceous beer deposits create very foamy conditions when solubilized and this can cause problems during cleaning. Hence, these cleaning compositions require de-foaming agents to prevent what could result in otherwise hazardous conditions due to the buildup of the foam.

Many of these detergent additives known in the industry are not stable when incorporated into the concentrated alkaline cleaners. Glucoside surfactants have been used extensively in this area but have certain drawbacks and have proven less than effective. One of the commercially available surfactants previously used in this regard is an alkoxylated alcohol (Poly-Tergent S-305-LF; Olin Corp.) which is incompatible when mixed with high levels of sodium hydroxide and most of it separates at the surface of the solution mixture. This separation problem greatly reduces the products cleaning and anti-foaming characteristics. Another potential problem that results is the cleaners contamination of the beer facilities production systems. Since the separation of the surfactant from the cleaner would result in the chemical being discharged in a pure dose when the tank is emptied, the "oily" nature of the surfactant will result in the undesirable deposit of the surfactant on production parts, the fermentation tanks, etc. If not removed, these additional deposits would lead to serious contamination problems.

SUMMARY OF THE INVENTION

Highly alkaline caustic cleaners used in large scale industrial applications are stabilized and enhanced with improved surface tension reduction and decreased foaming properties through the incorporation of minor amounts of a surfactant composition comprising a sultaine surfactant and a nonionic ethoxylated surfactant.

In certain embodiments, this invention relates to a low foaming, stable, hard surface detergent composition useful in concentrated highly alkaline caustic cleaners comprising a mixture of an amphoteric surfactant and an alkoxylated nonionic surfactant. These aqueous cleaner concentrates typically are comprised of about 40% to about 50% of sodium hydroxide and from about 0.05% to about 5% of a mixture of an amphoteric surfactant and an alkoxylated nonionic surfactant, with the balance being water and other optional ingredients. The compositions also optionally contain a chelating agent, e.g. sodium gluconate and or EDTA, in an amount from about 0.1% to about 10%. Potassium hydroxide can be substituted for all or part of the sodium hydroxide. It should be noted that the solubility of potassium hydroxide in water is typically limited to about 45% by weight and so care should be taken to ensure that the amount of potassium hydroxide will not be greater than that needed to saturate the solution. The composition may also contain an alkaline builder such as a sodium or potassium salt of a phosphate, a silicate, a carbonate, a citrate, a borate, or a mixture thereof, in an amount from about 0. 1% to about 10% by weight.

DETAILED DESCRIPTION OF THE INVENTION

It has been surprisingly and unexpectedly discovered that a unique blend of an alkylether hydroxypropyl sultaine surfactant together with an alkoxylated nonionic surfactant is a stabilized, highly effective surface active agent that is useful in high alkaline caustic cleaner compositions. The highly alkaline cleaners utilize sodium hydroxide (NaOH) in concentrations of up to 50% (typically at least 35% and more typically from about 40% to about 50%) and this has a destabilizing effect on most surfactant systems, resulting in high levels of foaming and separation of most surfactants into an oily phase.

A second advantage of the surfactant composition of the present invention is that it lowers the foaming of the system without the need for additional silicas otherwise necessary for this purpose. The stability problems result from the fact that prior to use, the highly alkaline caustic cleaners are packaged as a concentrate for shipping, handling and storage purposes. These caustic cleaner concentrates are composed of the following, with each of the percentages given as a total weight percent of the whole.

TABLE 1

CAUSTIC CLEANER CONCENTRATE

| COMPONENT | WEIGHT % |
|---|---|
| Sodium Hydroxide - 50% | 93.85 |
| Sodium Gluconate - 40% | 5.85 |
| Surfactant - 75% | 0.30 |

These concentrates are diluted with water at the site of application to yield the following approximate actual use dilutions.

TABLE 2

| ACTUAL USE DILUTION | |
|---|---|
| COMPONENT | WEIGHT % |
| Water | 94.000 |
| Sodium Hydroxide - 50% | 5.631 |
| Sodium Gluconate - 40% | 0.351 |
| Surfactant - 75% | 0.018 |

Using these diluted cleaner compositions, the surfactane composition of the present invention can be incorporated in very low levels yet achieve surprising results in terms of surface tension reduction for the removal of solids from the tank walls and the prevention of foam which is otherwise detrimental to the system. Tank wall deposits that develop thereon (also known as "beer stone" deposits) are actually proteinaceous accumulations which otherwise react with most surfactants and foam extensively. This does not happen using the composition of the present invention.

The amphoteric surfactant/nonionic ethoxylate surfactant blend is preferably that of an alkylether hydroxypropyl sultaine and a linear or branched alcohol alkoxylate nonionic surfactant. The two surfactants can be combined in weight ratios of from about 1:3 to 3:1, respectively. Suitable alcohol alkoxylate surfactants include linear or branched chain alkoxylates, ethylene oxide, propylene oxide and block or randomized copolymers capped with chlorine, acetate groups, benzene groups, alkanes and mixtures thereof.

The alkylether hydroxy propyl sultaines that comprise one component of the surfactant composition of the present invention may be represented generally by the formula:

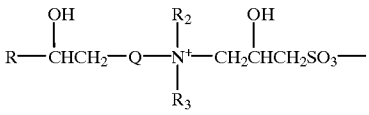

wherein R is selected from the group consisting of alkyl, aryl, or alkylaryl of 2–18 carbons and alkoxymethyl wherein the alkoxy group is of 2–18 carbon atoms, $R_2$ and $R_3$ are individually selected from the group consisting of methyl, or an alkyl of 2 to 6 carbon atoms wherein said alkyl group is substituted by an electron-donating group on the beta carbon atom thereof; polyoxyethylene and polyoxypropylene or $R_2$ and $R_3$ may jointly form a —$CH_2CH_2OCH_2CH_2$—or—$CH_2CH_2SCH_2CH_2$—group so as to form, together with the nitrogen atom to which they are bound, a morpholine or thiomorpholine ring; Q is a covalent bond or:

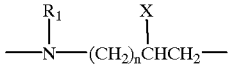

wherein $R_1$ is independently selected from the same groups as $R_2$ and $R_3$ or is:

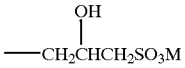

wherein M is hydrogen or an alkali metal cation, n is 0 or 1, and X is hydrogen or an electron-donating group.

These surfactants are described in greater detail in U.S. Pat. No. 4,891,159 to Nadolsky which is hereby incorporated by reference.

Specific copolymers useful as the alcohol alkoxylate component of the present invention may be represented by the following chemical structures:

a) a block polymer having the formula:

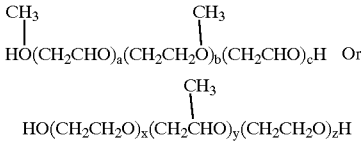

or mixtures thereof;

(b) a trimethylol propane initiated polypropylene oxide having the formula:

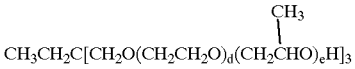

optionally in admixture with polypropylene glycol having the formula:

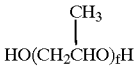

(c) an alcohol alkoxylate heteric copolymer having the formula:

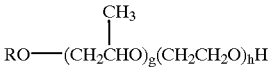

or

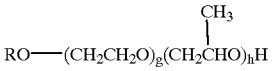

wherein R is a linear or branched chain alkyl having from 4 to 22 carbon atoms or a mixture thereof, and the lettered subscripts have the following values:

| | |
|---|---|
| the sum of a + c = | 20 to 70 |
| b = | 4 to 30 |
| d = | 0 to 50 |
| e = | 30 to 100 |
| f = | 25 to 100 |
| g = | 4 to 15 |
| h = | 0 to 10 |
| the sum x + z = | 4 to 15 |
| y = | 40 to 80 |

with the proviso that the propylene oxide units, with respect to ethylene oxide units, predominate in the overall composition.

These block copolymers and their synthesis are discussed in greater detail in U.S. Pat. No. 5,045,232 to Dahanayake et al. which is hereby incorporated by reference.

The composition may then be incorporated into the high alkaline caustic cleaner concentrate in the following weight percentages which when diluted in water at the site of application will yield the corresponding concentrate in solution. This is the actual concentration wherein the composition functions as both a cleaner and anti-foaming agent.

TABLE 3

| % SURFACTANT IN CONCENTRATE VS. DILUTION | |
|---|---|
| % SURFACTANT IN CONC. | % SURFACTANT IN DILUTION |
| 0.17 | 0.010 |
| 0.20 | 0.012 |
| 0.25 | 0.015 |
| 0.30 | 0.018 |
| 0.33 | 0.018 |
| 0.42 | 0.020 |
| 0.50 | 0.030 |
| 0.60 | 0.036 |

The surfactant composition proved to be an effective tension reduction/anti-foam agent at all of these use levels while remaining stable when stored over long periods of time in the highly concentrated form. Superior performance was achieved when the detergent/anti-foam composition was incorporated in the concentrate in amounts of from 0.3377 wt. % to about 0.45 wt. %. These levels give the greatest surface tension reduction properties and up to 50% reduction in foam height.

The low foaming detergent composition of the present invention may optionally include additional defoaming excipients such as silica, and in particular, precipitated silicas, fumed silicas, hydrophobically modified silicas and mixtures thereof. These excipients are added to the composition in minor amounts of from .001 wt. % to about 4.0 wt. % based on the total weight of the detergent composition.

The following examples are provided to better describe and more specifically set forth the compositions and their use. It is recognized that minor alterations and changes may be made with respect to the formulations and/or their amounts which are not described herein. To the extent that any such variations do not materially change the final composition and the effects achieved thereby, they are to be considered as falling within the spirit and scope of the invention as later recited in the claims.

EXAMPLE 1

The foaming/defoaming properties of the detergent blend in a highly alkaline caustic cleaner were evaluated using the dynamic foam test. This test studies the ability of a solution to generate foam when mechanically agitated as well as defoam over a period of time. As the solution circulates through the system, the resultant foam height is measured at 5, 10 and 15 minute intervals. After 15 minutes, the machine is turned off and again the foam is measured at 5, 10 and 15 minute intervals to study the product's defoaming properties.

Two proteinaceous "beer stone" samples were obtained; one from the bottom of a fermentation tank and one from the middle of the tank. These were then mixed together to produce a product that could be viewed as fairly representative of the entire tank. A highly alkaline caustic cleaner was also prepared according to the following formulation in the concentrate.

TABLE 4

| COMPONENT | WEIGHT % |
|---|---|
| Sodium hydroxide - 50% | 94.25 |
| Sodium Gluconate - 40% | 5.75 |

Small amounts of the detergent/anti-foaming agent were added to the concentrate in the following amounts: a) 0.3377%; b) 0.40%; c) 0.45%; d) 0.50%. The test was run and the results are as follows:

TABLE 5

| DYNAMIC FOAM HEIGHT OF CAUSTIC SOLUTIONS vs. TIME (min.) | | | | | | |
|---|---|---|---|---|---|---|
| Surfactant | Foam Height (cm) | | | Defoam Height (cm) | | |
| Blend % | 5 | 10 | 15 | 5 | 10 | 15 |
| 0.3377 [control] | 4.0 | 5.5 | 7.0 | 5.0 | 3.0 | 2.0 |
| 0.4000 | 4.0 | 5.5 | 7.0 | 3.0 | 2.0 | 1.0 |
| 0.4500 | 2.0 | 3.0 | 3.5 | 1.0 | 0.5 | 0.5 |
| 0.5000 | 2.0 | 2.5 | 3.0 | 1.0 | 0.7 | 0.5 |

The results indicate that raising the level from 0.3377% to 0.4000% would have a minimal impact on the product's low foaming properties. However, adding 0.4500% to the caustic concentrate would have a great impact practically cutting the foam levels in half. And finally, raising the surfactant blend level once again to 0.500% would not have significantly improved the defoam properties over the 0.4500% levels.

The preferred level of the surfactant blend (0.4500%) was also found to be stable and compatible with the caustic solution for one week at 45° C., 22° C., and 4° C.

EXAMPLE 2

The surfactant compositions ability to reduce the surface tension in an aqueous, highly alkaline caustic cleaner was also investigated. This was also compared with a commercially available alkoxylated alcohol nonionic surfactant known in the art. A high alkaline caustic cleaner concentrate was used as set forth below, including the weight percentage of added surfactant.

TABLE 6

| CAUSTIC CLEANER CONCENTRATE | |
|---|---|
| COMPONENT | WEIGHT % |
| Sodium Hydroxide - 50% | 93.85 |
| Sodium Gluconate - 40% | 5.85 |
| Surfactant | 0.30 |

The actual use dilution percentages tested were the same as those set forth in Table 2. The surface tension of the aqueous caustic/surfactant system was measured using a spindle wick tensiometer as is known in the art and plotted as a function of the surfactant blend concentration. As can be seen from FIG. 1, whereas the surface tension initially remained high, once the surfactant/wetting agent blend reached a concentration of 0.001% which is still a very low amount, the composition significantly reduces the surface tension properties of the system. As can be further seen, the surface tension reduction is the greatest between a surfactant blend concentration of between 0.001 wt. % and 0.01 wt. % although the surface tension continued to drop with increasing surfactant concentration. A similar test was attempted using the commercially available alcohol ethoxylate. This was not possible however, due to the incompatibility of the surfactant with the caustic cleaner system, resulting in its separation out of solution and the formation of an oily layer.

Referring now to FIG. 2, the ability of the amphoteric/nonionic surfactant blend to lower the surface tension of an aqueous system is shown under dilute conditions. Using the same concentrated high alkaline cleaners as before, the dilute concentrations were prepared as follows:

TABLE 7

| ACTUAL USE DILUTION | |
|---|---|
| COMPONENT | WEIGHT % |
| Water | 94.000 |
| Sodium Hydroxide - 50% | 5.631 |
| Sodium Gluconate - 40% | 0.351 |
| Surfactant | 0.018 |

As can be seen from FIG. 2, surface tension was measured in terms of dynes/cm and plotted as a function of increasing surfactant concentration within a high alkaline caustic cleaner whose concentration remained constant. Again it is clear that even at extremely low concentrations of 0.001 wt. %, the surfactant blend affords significant decreases in the surface tension of a system and hence superior surface cleaning capabilities.

EXAMPLE 3

The foam heights and surface tension properties of three highly alkaline caustic cleaner systems were compared. One system comprised the amphoteric/nonionic surfactant blend of the present invention while the other comprised a blend of two commercially available surfactant systems; Mazon 40 [an alkylglucosic nonionic surfactant] and Macol LF-120 (a polyalkoxylated aliphatic ether), both from PPG Industries, Pittsburgh, Pa. The concentrated high alkaline caustic cleaners compared were comprised as follows:

TABLE 8

| CONCENTRATED CAUSTIC BREWERY CLEANERS % SURFACTANT IN CONCENTRATE | | |
|---|---|---|
| COMPONENT | I | II |
| Sodium Hydroxide - 50% | 94.25 | 94.20 |
| Sodium Gluconate - 40% | 5.50 | 5.50 |
| Amphoteric/Nonionic Blend | 0.25 | — |
| Mazon 40 (PPG) | — | 0.27 |
| Macol LF-120 (PPG) | — | 0.03 |
| Total | 100.00 | 100.00 |

The foaming properties of each in an aqueous dilute cleaning system described above were calculated using the dynamic foam test as before. As a control, the high alkaline caustic cleaner above was compared to other caustic cleaners which included one of the respective surfactant systems. To each was added proteinaceous beer stone deposits. The results are as follows:

TABLE 9

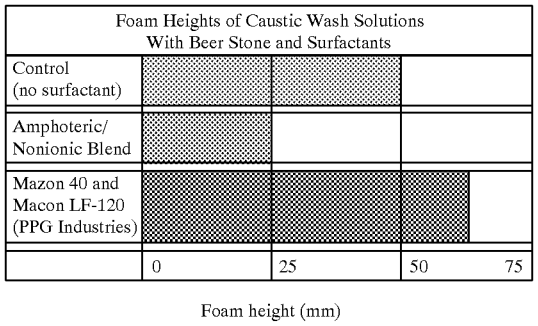

Clearly, the amphoteric/nonionic blend of the present invention significantly reduces the amount of foam produced as compared to both the control, which resulted in twice as much foam produced, and the commercially available surfactant blend which resulted in two and one half [2½] times as much foam produced.

EXAMPLE 4

The same high alkaline caustic cleaner/detergent systems compared in Example 3 were tested as to their surface tension reduction properties in the same manner as before as the surface tension reduction values were calculated in terms of dynes/cm and were plotted as a function of surfactant blend concentration. As can be seen by the declining slope, both surfactants produce equally good results at the extremely low concentrations and yet here the amphoteric/nonionic blend of the present invention is even incorporated at a lower concentration [see Table 4; 0.25 wt. % vs. 0.30 wt. %] and therefore affords the same cleaning efficacy at lower concentrations than the commercially available blend.

What we claim is:

1. A stable, concentrated, highly alkaline caustic cleaner composition comprising:

a) sodium hydroxide in an amount of from about 35 wt. % to 50 wt. % of said concentrate, b) sodium gluconate in an amount of from about 5.0 wt. % to about 10 wt. %, c) a detergent blend consisting essentially of a mixture of an alkylether hydroxypropyl sultaine amphoteric surfactant and an alkoxylated nonionic surfactant, said blend in an amount of from about 0.1 wt. % to about 0.5 wt. %, said alkoxylated nonionic surfactant being selected from the group consisting essentially of linear or branched chain alcohol alkoxylate surfactants, ethlene oxide copolymers, propylene oxide copolymers, and block or randomized copolymers capped with a moiety selected from the group consisting of chlorine, acetate benzene, alkanes, and mixtures thereof, and d) water.

2. The alkaline cleaner composition of claim 1, wherein said amphoteric surfactant and said alkoxylated nonionic surfactant are blended together in weight ratios of from about 5:1 to 1:5 respectively.

3. The alkaline cleaner composition of claim 2 wherein said amphoteric surfactant and said alkoxylated nonionic surfactant are blended together in a weight ratio of from about 3:1 to 1:3 respectively.

4. The low foaming detergent composition of claim 3 wherein said alkylether hydroxy propyl sultaine comprises the structure:

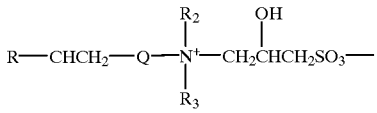

wherein R is selected from the group consisting of alkyl, aryl, or alkylaryl of 2–18 carbons and alkoxymethyl wherein the alkoxy group is of 2–18 carbon atoms, $R_2$ and $R_3$ are individually selected from the group consisting of methyl, or an alkyl of 2 to 6 carbon atoms wherein said alkyl group is substituted by an electron-donating group on the beta carbon atoms thereof; polyoxyethylene and polyoxypropylene or $R_2$ and $R_3$ may jointly form a —$CH_2CH_2OCH_2CH_2$—or —$CH_2CH_2SCH_2CH_2$—group so as to form, together with the nitrogen atom to which they are bound, to form a morpholine or thiomorpholine ring; Q is a covalent bond or:

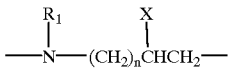

wherein $R_1$ is independently selected from the same groups as $R_2$ and $R_3$ or is:

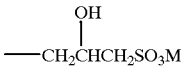

wherein M is hydrogen or an alkali metal cation, n is 0 or 1, and X is hydrogen or an electron-donating group.

5. The alkaline cleaner composition of claim 4 wherein said copolymers are selected from the group consisting essentially of:

(a) a block polymer having the formula:

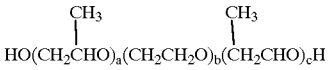

or

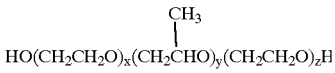

or mixtures thereof;

(b) a trimethylol propane initiated polypropylene oxide having the formula:

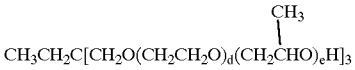

optionally in admixture with polypropylene glycol having the formula:

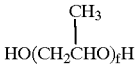

(c) greater than 10 to less than 90% by weight of an alcohol alkoxylate heteric copolymer having the formula:

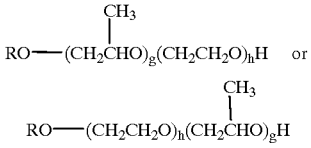

wherein R is a linear or branched chain alkyl having from 4 to 22 carbon atoms or a mixture thereof, and the lettered subscripts have the following values:

| | |
|---|---|
| the sum of a + c = | 20 to 70 |
| b = | 4 to 30 |
| d = | 0 to 50 |
| e = | 30 to 100 |
| f = | 25 to 100 |
| g = | 4 to 15 |
| h = | 0 to 10 |
| the sum x + z = | 4 to 15 |
| y = | 40 to 80 |

with the proviso that the propylene oxide units, with respect to ethylene oxide units, predominate in the overall composition.

6. The alkaline cleaner composition of claim 5 wherein said detergent is incorporated in said concentrated highly alkaline caustic cleaner in an amount of from about 0.30 wt. % to about 0.55 wt. % based on the total weight of the cleaner composition.

7. The detergent composition of claim 6 further comprising a defoaming excipient selected from the group consisting essentially of silica, fumed silica, hydrophobically modified silica and mixtures thereof.

8. The detergent composition of claim 7 wherein said defoaming excipient is incorporated in said detergent composition in an amount of from about .001 wt. % to about 4.0 wt. % based on the total weight of the detergent composition.

* * * * *